US006635835B2

(12) United States Patent
Yamashita

(10) Patent No.: US 6,635,835 B2
(45) Date of Patent: Oct. 21, 2003

(54) ACCELERATION DETECTING DEVICE

(75) Inventor: Toshiyuki Yamashita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/079,415

(22) Filed: Feb. 22, 2002

(65) Prior Publication Data

US 2003/0051984 A1 Mar. 20, 2003

(30) Foreign Application Priority Data

Sep. 19, 2001 (JP) ..... 2001-285535

(51) Int. Cl.[7] ..... H01H 35/14

(52) U.S. Cl. ..... 200/61.45 R; 200/61.52; 200/61.53

(58) Field of Search ..... 73/488, 504.12, 73/504.13, 504.14, 514.01, 514.24, 514.38; 200/61.45 R, 61.52, 61.53

(56) References Cited

U.S. PATENT DOCUMENTS 3,132,220 A * 5/1964 Uri et al. ..... 200/61.45 R
4,039,790 A * 8/1977 Treckman ..... 200/61.53
5,675,134 A * 10/1997 Swart et al. ..... 200/61.45 M
5,801,348 A * 9/1998 Asada ..... 200/61.53

FOREIGN PATENT DOCUMENTS

JP 6-222069 8/1994 ..... G01P/15/02

* cited by examiner

*Primary Examiner*—Michael Friedhofer
(74) *Attorney, Agent, or Firm*—Sughrue Mion, PLLC

(57) ABSTRACT

An acceleration detecting device is provided with a mass body (1) having a through hole (1*a*) and a sliding shaft (2) passing through the through hole (1*a*) and sliding the mass body (1) and is constituted such that the slicing shaft (2) comes in contact with the through hole (1*a*) at two points (3*a*) and (3*b*) to support the mass body (1). When the through hole (1*a*) is circular in cross section, the cross section of the sliding shaft (2) is formed in the shape of an ellipse elongated in the lateral direction or in the shape of an oblong circle elongated in the lateral direction.

10 Claims, 7 Drawing Sheets

ACCELERATION DETECTING DEVICE

BACKGROUND OF THE INVENTION

1. Field of the Invention

The present invention relates to an acceleration detecting device of a passive safety system for driving and controlling a passive safety device of a vehicle.

2. Description of Related Art

A conventional acceleration detecting device will be described which is provided in a control unit (passive safety system) for controlling the operation of a passive safety device of a vehicle such as an air bag system or the like.

FIG. 11 is an illustration to show an example of a position where a control unit including a conventional acceleration detecting device and a passive safety device are disposed in a vehicle and to show a view when viewed from the top side of the vehicle. In FIG. 11, a reference character 110 denotes a control unit having the acceleration detecting device disposed in the center tunnel (not shown) of the vehicle. A reference character 111 denotes the passive safety device disposed in a steering wheel (not shown).

FIG. 12 is a side view to show a schematic configuration of the conventional acceleration detecting device. In FIG. 12, a reference character 100 denotes the acceleration detecting device. A reference character 101 denotes a mass body having a mass and a reference character 102 denotes a sliding shaft for slidably supporting the mass body 101. A reference character 103 denotes an elastic body disposed in such a way as to surround the sliding shaft 102. When the acceleration detecting device 100 is not operated, the mass body 101 is pressed onto one side by the elastic force of the elastic body 103. A reference character 104 denotes movable contact points each formed in the shape of a spring and fixed to the top and bottom of the mass body 101. A reference character 105 denotes fixed contact points fixed to the ceiling portion and bottom portion of a tunnel-shaped hole, made in the acceleration detecting device 100, into which the mass body 101 goes when it slides on the sliding shaft 102.

FIGS. 13A and 13B are illustrations of the mass body 101 and the sliding shaft 102 constituting a part of the conventional acceleration detecting device 100. FIG. 13A is a perspective view of the mass body and the sliding shaft in the ordinary state where the acceleration detecting device 100 is not operated and FIG. 13B is a cross-sectional view. In FIG. 13, a reference character 101 denotes the mass body. The mass body 101 is made of brass, for example, and has a predetermined mass. A reference character 101*a* denotes a through hole made through the mass body 101. A reference character 102 denotes the sliding shaft passing through the through hole 101*a* and being fixed. The sliding shaft 102 is made of, for example, a PBT (polybutylenephthalate) resin or the like and is circular in cross section. The through hole 101*a* and the sliding shaft 102 are formed, for example, by a die molding method or the like. The circle of the cross section of the mass body 101 is larger than the circle of the cross section of the sliding shaft 102, so the mass body 101 can slide on the sliding shaft 102. A reference character Gz denotes a gravity component applied to the mass body 101.

In the state where the acceleration detecting device 100 including the mass body 101 and the sliding shaft 102 is not operated (hereinafter referred to as an ordinary state), only the gravity Gz is applied to the mass body 101 and thus the upper portion of the mass body 101 is in contact at one point with the upper portion of the sliding shaft 102.

Next, the operation of the acceleration detecting device 100 will be described.

In the case where a vehicle collides with an object in front of the vehicle and receives an impact (deceleration), the mass body 101 receives an inertial force from the impact. In the case of a large impact, the inertial force overcomes the elastic force of the elastic body 103 to slide the mass body 101 on the sliding shaft 102 to put the mass body 101 into the tunnel-shaped hole. When the mass body 101 moves a distance larger than a predetermined distance, the movable contact points 104 come in contact with the fixed contact points 105 to bring these two contact points into electric conduction.

The acceleration detecting device 100 is a mechanical type device and the control unit 110 has double circuits of the acceleration detecting device 100 and an electromechanical acceleration detecting device (semiconductor acceleration sensor). Only after both the circuits output a signal to operate the passive safety device 111, the passive safety device 111 is operated. The circuits for operating the passive safety device 111 will be described in the following.

FIG. 14 is a circuit diagram to show an electric configuration of the control unit 110 provided with the conventional acceleration detecting device 100 and the passive safety device 111. In FIG. 14, a reference character 112 denotes a power source. A reference character 113 denotes a semiconductor-type acceleration sensor having a function of detecting an impact acceleration applied to the vehicle. A reference character 114 denotes a microcomputer having a function of processing a signal from the semiconductor-type acceleration sensor 113. A reference character 115 denotes a semiconductor switch for opening or closing a driving circuit of the passive safety device 111.

The control unit 110 is constituted by the power source 112, the semiconductor-type acceleration sensor 113, the microcomputer 114, the semiconductor switch 115 and the mechanical acceleration detecting device 100. Further, the passive safety device 111 is constituted by the driving circuit, opened or closed by the semiconductor switch 115, and the safety device body.

Next, the operation of the circuit of the control unit 110 and the passive safety device 111 will be described.

For example, in the case where a vehicle collides head-on with an object, the semiconductor-type acceleration sensor 113 disposed in the control unit 110 detects an impact acceleration and outputs a detected acceleration signal to the microcomputer 114. The microcomputer 114 converts the signal from the semiconductor-type acceleration sensor 113 into digital data by means of an internal A/D converter and performs a predetermined processing to close the semiconductor switch 115 if the impact is larger than a predetermined value.

Further, similarly, in the mechanical acceleration detecting device 100 disposed in the control unit 110, in the case where an impact larger than a predetermined value is applied to the vehicle, as described above, the internal contact points are brought into conduction to close the circuit.

In this manner, when the vehicle receives the impact larger than the predetermined value, both circuits of the semiconductor switch 115 and the mechanical acceleration detecting device 100 are closed to pass a current through the driving circuit of the passive safety device 111, thereby operating the passive safety device 111.

The acceleration detecting device in the conventional passive safety device of the vehicle is constituted in this manner and performs the predetermined operation.

However, since both of the mass body 101 and the sliding shaft 102 are circular in cross section, the movement of the mass body 101 becomes unstable, depending on the direction of collision of the vehicle, and when the mass body 101 slides on the sliding shaft 102, the mass body 101 rattles. In this case, there is presented a problem that the timing of operation of the passive safety device might be delayed.

The problem will be described in detail in the following.

In the case where the vehicle collides head-on with the object, the direction of impact applied to the mass body 101 agrees with the direction of detecting an acceleration, that is, the axial direction of the sliding shaft 102. For this reason, the mass body 101 can stably slide on the sliding shaft 102.

Next, the case will be described where the vehicle collides obliquely with the object. FIGS. 15A to 15C are illustrations to show the contact state where the mass body 101 is put into contact with the sliding shaft 102 in the case where the vehicle collides obliquely with the object. FIG. 15A is a perspective view and FIGS. 15B and 15C are cross-sectional views. In FIG. 15A, a reference character Gz denotes a gravity component applied to the mass body 101 and a reference character Gx denotes an impact acceleration component in the direction of the sliding shaft 102. A reference character Gy denotes an impact acceleration component produced in the left and right direction, assuming that the direction of the sliding shaft 102 is the front and rear direction.

In the case where the vehicle collides obliquely with the object, the impact applied to the mass body 101 produces not only an impact acceleration component Gx in the direction of the sliding shaft 102 but also an impact acceleration component Gy in the direction at an angle of 90 degrees with respect to the direction of the Gx on the horizontal plane. In the ordinary state where the acceleration detecting device 100 is not operated, only the gravity Gz is applied to the mass body 101 and thus the mass body 101 comes in contact with the sliding shaft 102 at one point of the upper portion (see FIG. 13B).

However, when the vehicle collides obliquely with the object, the impact acceleration components Gx, Gy in the horizontal direction are larger than the gravity component Gz in the vertical direction, so the mass body 101 moves in the horizontal direction at an angle of 90 degrees with respect to the sliding shaft 102 and comes in contact with the sliding shaft 102 at one point in the left and right direction. A rotational moment is produced by a frictional force, produced by the contact, between the mass body 101 and the sliding shaft 102 to rotate the mass body 101, thereby rattling the mass body 101 when the mass body 101 slides.

FIG. 15C is a cross-sectional view to show the state where the mass body 101 rotates around the sliding shaft 102. As described above, in the case where the rotational moment is produced to rotate the mass body 101, the rotational moment depends on the frictional force and makes the movement of the mass body 101 unstable if the surface conditions of the through hole 101*a* of the mass body 101 and the sliding shaft 102 are not uniform. Thus, this raises the possibility that the timing of operation of the passive safety device might be delayed.

SUMMARY OF THE INVENTION

The present invention has been made to solve the above problems. The object of the present invention is to provide an acceleration detecting device in which a mass body can stably slide on a sliding shaft, irrespective of the direction of an impact.

An acceleration detecting device in accordance with the present invention has a mass body having: a predetermined mass and a through hole made through the mass body; and a sliding shaft passing through the through hole and sliding the mass body, wherein the sliding shaft comes in contact with the through hole at two or more points to support the mass body.

In an acceleration detecting device in accordance with the present invention, when the through hole is circular in cross section, the sliding shaft is formed in such a shape that the sliding shaft comes in contact with the through hole at two or more points to support the mass body.

In an acceleration detecting device in accordance with the present invention, the sliding shaft has a cross section formed in the shape of an oblong circle elongated in the lateral direction.

In an acceleration detecting device in accordance with the present invention, the sliding shaft is provided with a projection for regulating the rotation of the mass body.

In an acceleration detecting device in accordance with the present invention, when the sliding shaft is circular in cross section, the through hole is formed in such a shape that the sliding shaft comes in contact with the through hole at two or more points to support the mass body.

In an acceleration detecting device in accordance with the present invention, the through hole is provided with a plane for regulating the rotation of the mass body.

DETAILED DESCRIPTION OF THE PREFERRED EMBODIMENTS

An embodiment of the present invention will be described below.

Embodiment 1

Figure 1A:
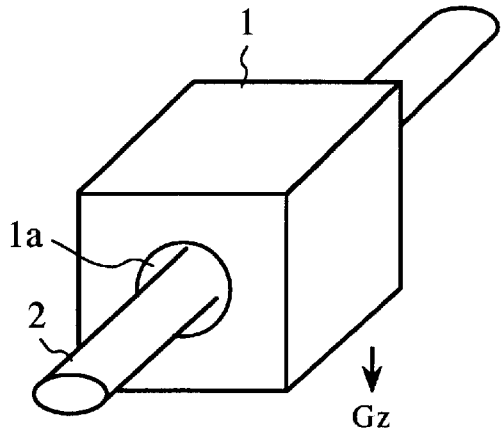
FIGS. 1A and 1B are illustrations of a mass body and a sliding shaft constituting an acceleration detecting device in accordance with an embodiment 1 of the present invention.
Figure 1B:
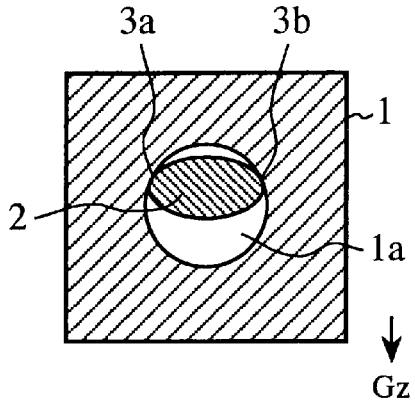

FIGS. 1A and B are illustrations of a mass body and a sliding shaft constituting an acceleration detecting device in accordance with an embodiment 1 of the present invention. FIG. 1A is a perspective view of the mass body and the sliding shaft in an ordinary state where the acceleration detecting device is not operated and FIG. 1B is a cross-sectional view.

In FIG. 1A, a reference character 1 denotes a mass body having a predetermined mass. The mass body 1 is made of brass, for example. A reference character 1*a* denotes a through hole made through the mass body 1. The through hole 1*a* is circular in cross section and can be easily formed, for example, by a die molding method or the like. A reference character 2 denotes a sliding shaft and is made, for example, of a PBT resin. The sliding shaft 2 has a cross section formed in the shape of an ellipse elongated in the lateral direction and is formed, for example, by the die molding method or the like. A reference character Gz denotes a gravity component applied to the mass body 1. The diameter in the direction of length of the ellipse is a little smaller than the diameter of the through hole 1*a*. In FIG. 1B, reference characters 3*a*, 3*b* denote contact points where the through hole 1*a* (mass body 1) comes in contact with the sliding shaft 2. The contact point 3*a* is at the upper right position of the through hole 1*a* and the contact point 3*b* is at the upper left position.

Since only the gravity Gz is applied to the mass body 1 in the ordinary state, the sliding shaft 2 comes in contact with the through hole 1*a* at the two points 3*a* and 3*b* to support the mass body 1.

Next, the operation of the acceleration detecting device will be described.

In the case where a vehicle collides head-on with an object, the direction of an impact applied to the mass body 1 agrees with the direction of detecting an acceleration, that is, the axial direction of the sliding shaft 2. For this reason, the mass body 1 can stably slide on the sliding shaft 2.

Next, the case will be described where the vehicle collides obliquely with the object.

Figure 2A:
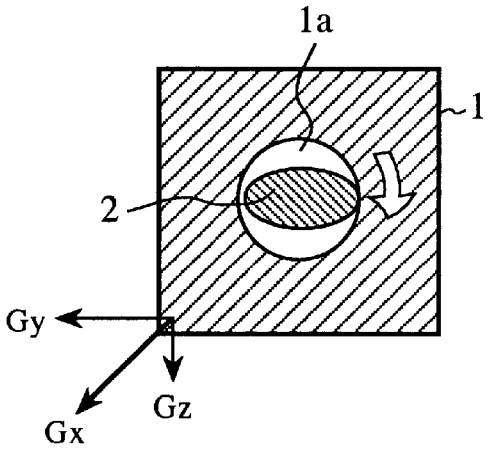
FIGS. 2A and 2B are cross-sectional views to show the state of a mass body and a sliding shaft when a vehicle collides obliquely with an object.
Figure 2B:
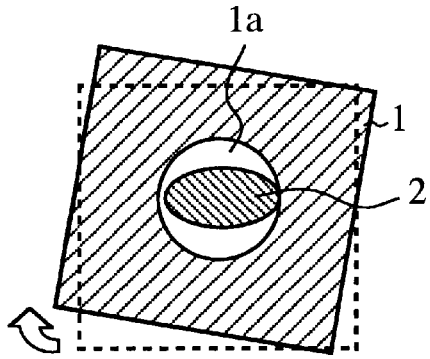

FIGS. 2A and 2B are cross-sectional views to show the state of the mass body 1 and the sliding shaft 2 when the vehicle collides obliquely with the object. In FIG. 2A, a reference character Gz denotes a gravity component applied to the mass body 1 and a reference character Gx denotes an impact acceleration component in the direction of the sliding shaft 2. A reference character Gy denotes an impact acceleration component produced in the left and right direction, assuming that the direction of the sliding shaft 2 is the front and rear direction. A curved thick arrow denotes a rotational moment.

In the case where an oblique collision occurs, acceleration components Gz and Gy in the horizontal direction are larger than the gravity component Gz and thus the mass body 1 moves in the horizontal direction (in the left and right direction) at an angle of 90 degrees with respect to the sliding shaft 2 and comes in contact with the sliding shaft 2 at one point in the left and right direction.

However, the sliding shaft 2 has a cross section formed in the shape of an ellipse elongated in the lateral direction and comes in contact with the mass body 1 at the two points 3*a* and 3*b* in the ordinary state to support the mass body 1, thereby reducing the amount of movement of the mass body 1 in the left and right direction. For this reason, this reduces a frictional force generated between the mass body 1 and the sliding shaft 2 and restrains a rotational moment and thus also the rotation of the mass body 1. FIG. 2B is a cross-sectional view to show the state where the mass body 1 is restrained from rotating. Since the rotational moment depends on the frictional force, it is possible to restrain the rotation of the mass body 1 by reducing the frictional force.

As described above, according to the embodiment 1, when the cross section of the through hole 1*a* is circular, the cross section of the sliding shaft 2 is formed in the shape of an ellipse elongated in the lateral direction, that is, in such a shape that the sliding shaft 2 comes in contact with the through hole 1*a* at the two points 3*a* and 3*b* to support the mass body 1. Thus, when the vehicle collides obliquely with the object, this configuration reduces the amount of movement of the mass body 1 in the direction at an angle of 90 degrees with respect to the sliding shaft (in the left and right direction) to restrain a rotational moment from being produced by the frictional force produced between mass body 1 and the sliding shaft 2, thereby producing an effect that when the mass body 1 slides, the mass body does not rattle but stably moves. Further, this configuration can produce an effect of providing an acceleration detecting device having the above effects without making a complex through hole.

Next, a modification of the embodiment 1 will be described.

Figure 3:
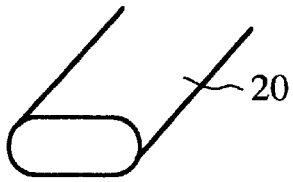
FIG. 3 is a perspective view, near the tip end, of a sliding shaft of an acceleration detecting device of a modification of the embodiment 1.

FIG. 3 is a perspective view, near the tip end, of a sliding shaft 20 of an acceleration detecting device of a modification of the embodiment 1. The sliding shaft 20 has a cross section formed in the shape of an oblong circle elongated in the lateral direction.

For this reason, in the ordinary state, the upper right end and the upper left end of the sliding shaft 20 come in contact with the upper right portion and the upper left portion of the through hole 1*a* of the mass body 1 to support the mass body 1. Therefore, this configuration can produce the same effect as the embodiment 1. In addition, this configuration can produce an effect of easily forming the sliding shaft 20 by the die molding method or the like because the sliding shaft has the oblong circular cross section. Since the other potions are the same as the embodiment 1, their detailed description will be omitted.

Embodiment 2

Figure 4A:
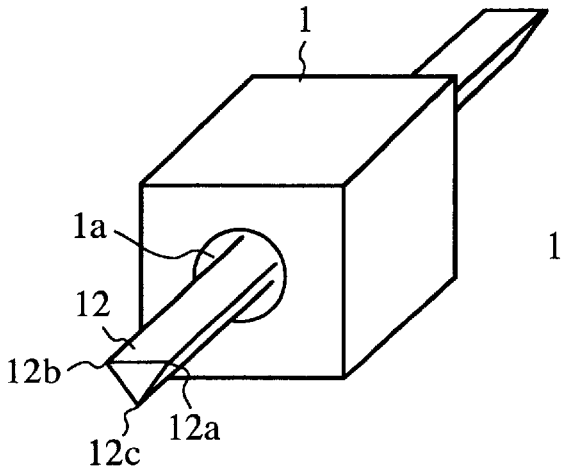
FIGS. 4A and 4B are illustrations of a mass body and a sliding shaft constituting an acceleration detecting device in accordance with an embodiment 2 of the present invention.
Figure 4B:
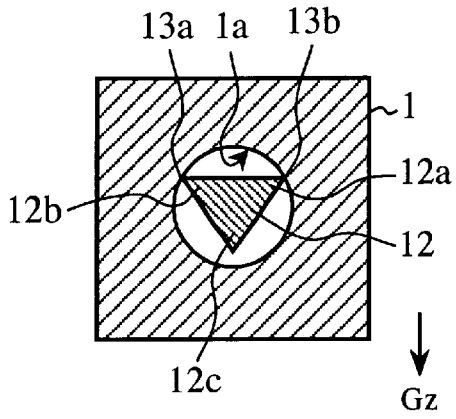

FIGS. 4A and 4B are illustrations of a mass body and a sliding shaft constituting an acceleration detecting device in accordance with an embodiment 2 of the present invention. FIG. 4A is a perspective view of the sliding shaft in the ordinary state and FIG. 4B is a cross-sectional view.

In FIG. 4A, a reference character 1 denotes a mass body and a reference character 1*a* denotes a through hole, as is the case with the embodiment 1. A reference character 12 denotes a sliding shaft and is made, for example, of a PBT resin. The sliding shaft 12 is formed in the shape of an equilateral triangle prism and hence its cross section is shaped like a equilateral triangle. Reference characters 12*a*, 12*b*, and 12*c* are the respective vertexes of the triangle of the cross section of the sliding shaft 12. In the sliding shaft 12, vertexes 12*a* and 12*b* are at upper positions and the vertex 12*c* is at a lower position, and the sliding shaft 12 is disposed so as to be sectionally formed in an inverted triangle. A reference character Gz denotes a gravity component applied to the mass body 1. In FIG. 4B, reference characters 13*a* and 13*b* denotes the contact points where the through hole 1*a* comes in contact with the sliding shaft 12. The contact point 13*a* is at the upper right portion of the through hole 1*a* and the contact point 13*b* is at the upper left portion.

Since only the gravity Gz is applied to the mass body 1 in the ordinary state, the sliding shaft 12 comes in contact with the two points 13*a* and 13*b* of the through hole 1*a* at the vertexes 12*a* and 12*b* of the sliding shaft 2 to support the mass body 1. The vertex 12*c* faces downward in vertical direction in the ordinary state and acts as a projection for regulating the rotation of the mass body 1 when the vehicle collides with the object.

Next, the operation of this acceleration detecting device will be described.

In the case where the vehicle collides head-on with the object, the direction of an impact applied to the mass body 1 agrees with the direction of detecting the acceleration, that is, the axial direction of the sliding shaft 12. For this reason, the mass body 1 can stably slide on the sliding shaft 12.

Next, the case will be described where the vehicle collides obliquely with the object.

Figure 5A:
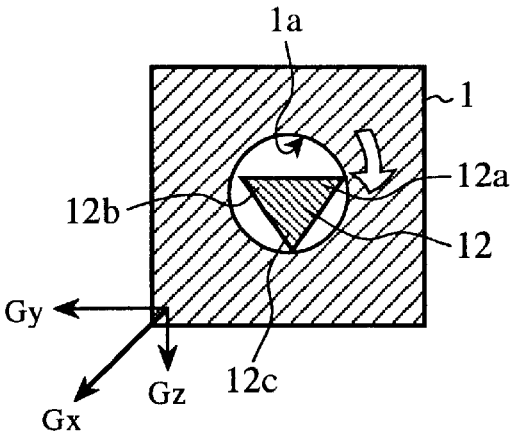
FIGS. 5A and 5B are cross-sectional views to show the state of a mass body and a sliding shaft when a vehicle collides obliquely with an object.
Figure 5B:
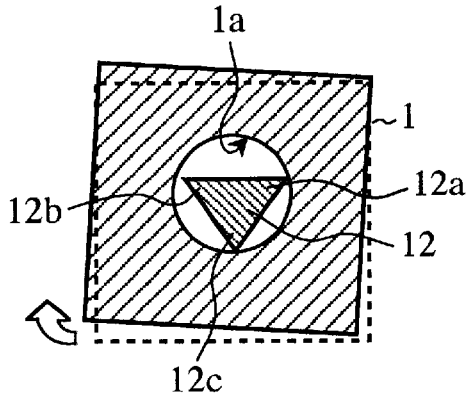

FIGS. 5A and 5B are cross-sectional views to show the state of the mass body and the sliding shaft 12 when the vehicle collides obliquely with the object. In FIG. 5A, a reference character Gz denotes a gravity component applied to the mass body 1 and a reference character Gx denotes an impact acceleration component in the direction of the sliding shaft 12. A reference character Gy denotes an impact acceleration component in the left and right direction, assuming that the direction of the sliding shaft 12 is the front and rear direction. A curved thick arrow denotes a rotational moment.

In the case where an oblique collision occurs, the acceleration components Gx and Gy in the horizontal direction are larger than the gravity component Gz and thus the mass body 1 moves in the horizontal direction (in the left and right direction) at an angle of 90 degrees with respect to the sliding shaft 12 and comes in contact with the vertex 12*a* or 12*b* (12*a,* in this case) of the sliding shaft 12 at one point in the left and right direction.

However, the cross section of the sliding shaft 12 is formed in the shape of an inverted triangle, that is, in such a shape that the vertexes 12*a* and 12*b* of the sliding shaft 12 come in contact with the mass body 1 at the contact points 13*a* and 13*b* in the ordinary state to support the mass body 1, which reduces the mount of movement in the left and right direction of the mass body 1. For this reason, this configuration can reduce the frictional force produced between the mass body 1 and the sliding shaft 12 to restrain the rotational moment and thus also the rotation of the mass body 1.

FIG. 5B is a cross-sectional view to show the state where the rotation of the mass body 1 is restrained. Since the rotational moment depends on the frictional force, the rotation of the mass body 1 can be restrained by reducing the frictional force. Further, a projection (vertex) 12*c* comes in contact with the mass body 1 (through hole 1*a*) being about to rotate to regulate the rotation of the mass body 1.

As described above, according to the present embodiment 2, when the cross section of the through hole 1*a* is circular, the cross section of the sliding shaft 12 is formed in the shape of an inverted triangle, that is, in such a shape that the sliding shaft 12 comes in contact with the through hole 1*a* at the two contact points 13*a* and 13*b* to support the mass body 1. Therefore, the present embodiment 2 can produce the same effects as the embodiment 1.

Further, according to the present embodiment 2, the sliding shaft 12 has the projection (vertex) 12*c* and thus further restrains the rotation of the mass body 1 when the oblique collision occurs. Therefore, the present embodiment 2 can produce an effect of further stably sliding the mass body 1.

Figure 6:
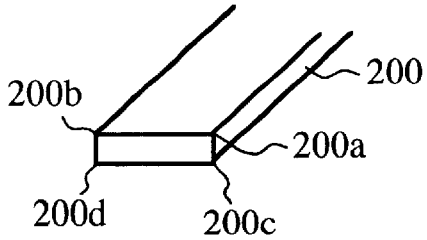
FIG. 6 is a perspective view, near the tip end, of a sliding shaft of an acceleration detecting device of a modification of the embodiment 2.

Next, a modification of the embodiment 2 will be described. FIG. 6 is a perspective view, near the tip end, of a sliding shaft 200 constituting an acceleration detecting device of a modification of the embodiment 2. In FIG. 6, a reference character 200 denotes a sliding shaft having a cross section formed in the shape of a rectangle elongated in the lateral direction. Reference characters 200*a,* 200*b,* 200*c* and 200*d* denote the respective interior angles of the rectangular cross section in the order of an upper right angle, an upper left angle, a lower right angle, and a lower left angle.

The interior angles 200*a* and 200*b* come in contact with the upper right portion and upper left portion of the through hole 1*a* in the ordinary state to support the mass body 1. The interior angles 200*c* and 200*d* act as projections for regulating the rotation of the mass body 1 when the vehicle collides obliquely with the object. For this reason, this modification can produce the same effect as the embodiment 2. Since the other portions are the same as the embodiment 2, their description will be omitted.

Embodiment 3

Figure 7A:
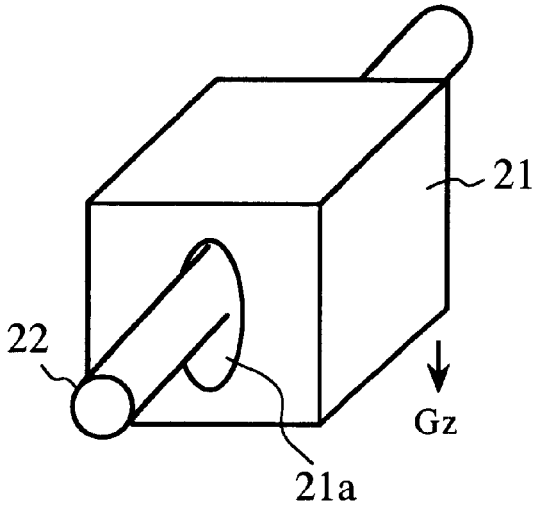
FIGS. 7A and 7B are illustrations of a mass body and a sliding shaft constituting an acceleration detecting device in accordance with an embodiment 3 of the present invention.
Figure 7B:
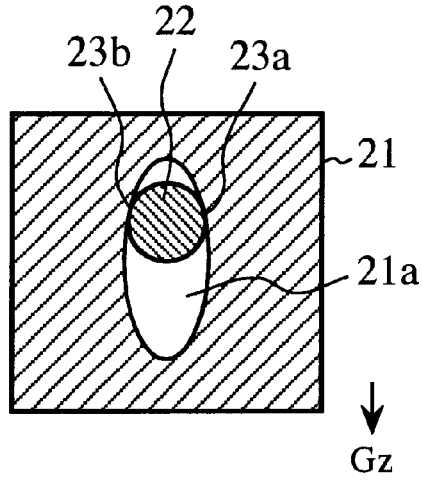

FIGS. 7A and 7B are illustrations of a mass body and a sliding shaft constituting an acceleration detecting device in accordance with an embodiment 3 of the present invention. FIG. 7A is a perspective view of the sliding shaft in the ordinary state and FIG. 7B is a cross-sectional view.

In FIG. 7A, a reference character 21 denotes a mass body having a predetermined mass. The mass body 21 is made, for example, of brass. A reference character 21*a* denotes a through hole made through the mass body 21. The through hole 21*a* has a cross section formed in the shape of an ellipse elongated in the longitudinal direction and can be easily formed, for example, by the die molding method or the like. A reference character 22 denotes a sliding shaft and is made, for example, of a PBT resin. The sliding shaft 22 is circular in cross section and can be easily formed, for example, by the die molding method.

The diameter in the horizontal direction of the center portion of the through hole 21*a* is larger than the diameter of the sliding shaft 22, but the upper portion and the lower portion of the ellipse elongated in the longitudinal direction are narrow enough not to permit the sliding shaft 22 to get in. A reference character Gz denotes a gravity component applied to the mass body 1. In FIG. 7B, reference characters 23*a* and 23*b* denote contact points where the through hole 21*a* (mass body 21) comes in contact with the sliding shaft 22. The contact point 23*a* is at the upper right position of the through hole 21*a* and the contact point 23*b* is at the upper left position.

Since only the gravity Gz is applied to the mass body 1 in the ordinary state and the sliding shaft 22 is large enough not to get in the top potion of the through hole 21*a,* the sliding shaft 22 comes in contact with the through hole 21*a* at the two points 23*a* and 23*b* to support the mass body 21.

Next, the operation of this acceleration detecting device will be described.

In the case where the vehicle collides head-on with the object, the direction of an impact applied to the mass body 21 agrees with the direction of detecting the acceleration, that is, the axial direction of the sliding shaft 22. For this reason, the mass body 21 can stably slide on the sliding shaft 22.

Next, the case will be described where the vehicle collides obliquely with the object.

Figure 8A:
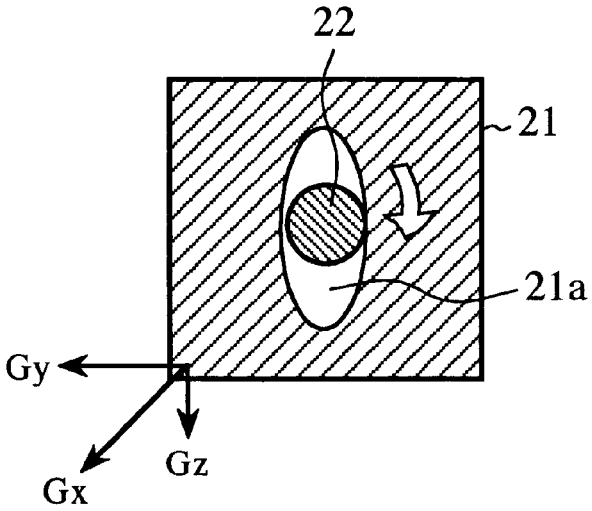
FIGS. 8A and 8B are cross-sectional views to show the state of a mass body and a sliding shaft when a vehicle collides obliquely with an object.
Figure 8B:
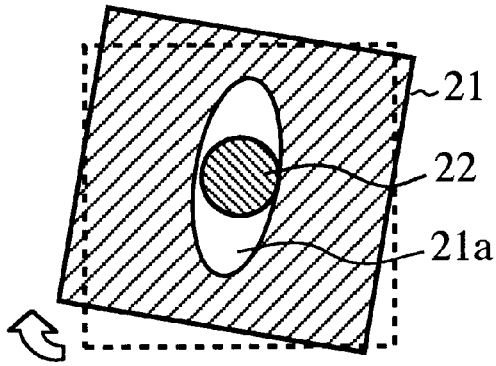

FIGS. 8A and 8B are cross-sectional views to show the state of the mass body 21 and the sliding shaft 22 when the vehicle collides obliquely with the object. In FIG. 8A, a reference character Gz denotes a gravity component applied to the mass body 21 and a reference character Gx denotes an impact acceleration component in the direction of the sliding shaft 22. A reference character Gy denotes an impact acceleration component produced in the left and right direction, assuming that the direction of the sliding shaft 22 is the front and rear direction. A curved thick arrow denotes a rotational moment.

In the case where the oblique collision occurs, acceleration components Gz and Gy in the horizontal direction are larger than the gravity component Gz and thus the mass body 21 moves in the horizontal direction (in the left and right direction) at an angle of 90 degrees with respect to the sliding shaft 22 and comes in contact with the sliding shaft 22 at one point in the left and right direction.

However, the mass body 21 has a cross section formed in the shape of an ellipse elongated in the longitudinal direction; that is, it is formed in such a shape that the sliding shaft 22 comes in contact with the mass body 21 at the two points 23*a* and 23*b* in the ordinary state to support the mass body 1, thereby reducing the amount of movement of the mass body 21 in the left and right direction. For this reason, this reduces a frictional force generated between the mass body 21 and the sliding shaft 22 and restrains a rotational moment and thus also the rotation of the mass body 21. FIG. 8B is a cross-sectional view to show the state where the mass body 21 is restrained from rotating. Since the rotational moment depends on the frictional force, it is possible to restrain the rotation of the mass body 21 by reducing the frictional force.

As described above, according to the embodiment 3, when the sliding shaft 22 is circular in cross section, the cross section of the mass body 21 is formed in the shape of an ellipse elongated in the longitudinal direction, that is, in such a shape that the sliding shaft 22 comes in contact with the through hole 21*a* at the two points 3*a* and 3*b* to support the mass body 1. Therefore, the present embodiment 3 can produce the same effect as the embodiment 1 and further can produce an affect of providing an acceleration device having the above-described effect without forming the sliding shaft in a complex shape.

Embodiment 4

Figure 9A:
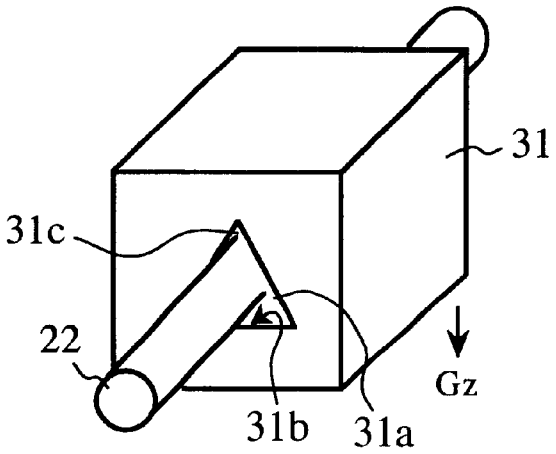
FIGS. 9A and 9*b* are illustrations of a mass body and a sliding shaft constituting an acceleration detecting device in accordance with an embodiment 4 of the present invention.
Figure 9B:
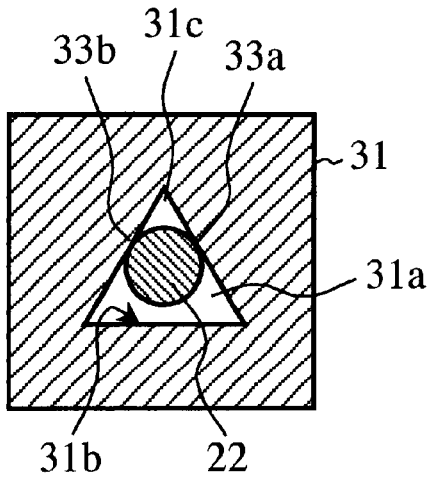

FIGS. 9A and 9B are illustrations of a mass body and a sliding shaft constituting an acceleration detecting device in accordance with an embodiment 4 of the present invention. FIG. 9A is a perspective view of the sliding shaft in the ordinary state and FIG. 9B is a cross-sectional view.

In FIG. 9A, a reference character 31 denotes a mass body having a predetermined mass. The mass body 31 is made, for example, of brass. A reference character 31*a* denotes a through hole made through the mass body 31. The through hole 31*a* has a cross section formed in the shape of an equilateral triangle and is formed, for example, by the die molding method or the like. A reference character 31*b* is the base plane of the though hole 31*a* of the mass body 31 and the collection of the bases of triangles of the cross sections of the mass body 31. The base plane 31*b* acts as a plane for regulating the rotation of the mass body 31. A reference character 31*c* denotes a vertical angle of the triangle of the cross section of the through hole 31*a* of the mass body 31. A reference character 22 denotes a sliding shaft which is the same as the sliding shaft in the embodiment 3.

The base of the triangle of the cross section of the through hole 31*a* is larger than the diameter of the sliding shaft 22. Further, the vertical angle 31*c* is narrow enough not to permit the sliding shaft 22 to get in. A reference character Gz denotes a gravity component applied to the mass body 31. In FIG. 9B, reference characters 33*a* and 33*b* denote the contact points where the through hole 31*a* comes in contact with the sliding shaft 22. The contact point 33*a* is at the upper right portion of the through hole 31*a* and the contact point 33*b* is at the upper left portion.

Since only the gravity Gz is applied to the mass body 31 in the ordinary state and the sliding shaft 22 is large enough not to get in the top portion of the through hole 31*a,* the sliding shaft comes in contact with the mass body 31 at the two contact points 33*a* and 33*b* to support the mass body 31.

Next, the operation of this acceleration detecting device will be described.

In the case where the vehicle collides head-on with the object, the direction of an impact applied to the mass body 31 agrees with the direction of detecting the acceleration, that is, the axial direction of the sliding shaft 22. For this reason, the mass body 31 can stably slide on the sliding shaft 22.

Next, the case will be described where the vehicle collides obliquely with the object.

Figure 10A:
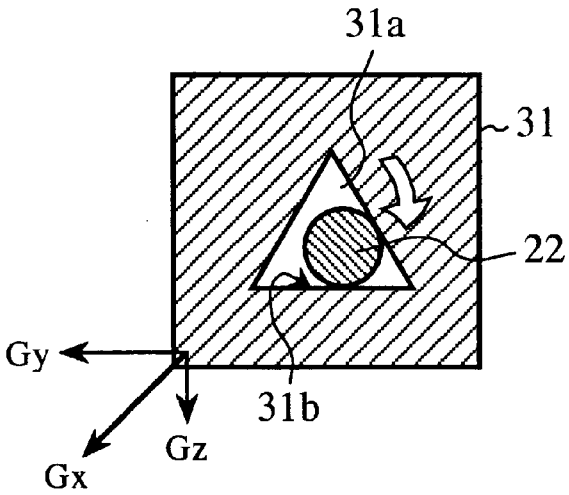
FIGS. 10A and 10B are cross-sectional views to show the state of a mass body and a sliding shaft when a vehicle collides obliquely with an object.
Figure 10B:
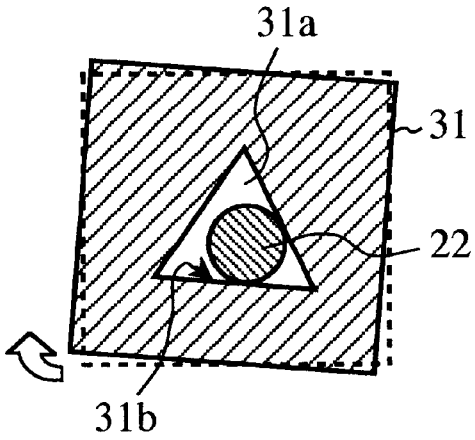
Figure 11:
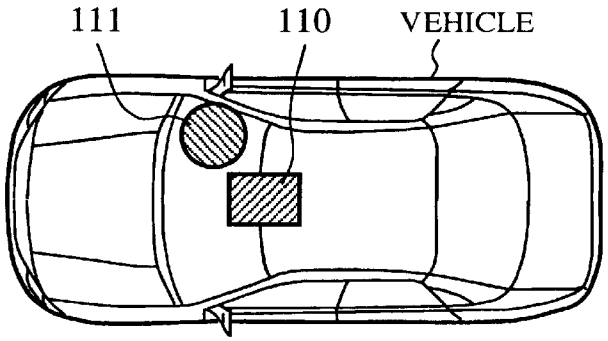
FIG.11 (PRIOR ART)
FIG. 11 is an illustration to show an example of a position where a control unit including a conventional acceleration detecting device and a passive safety device are disposed in a vehicle.
Figure 12:
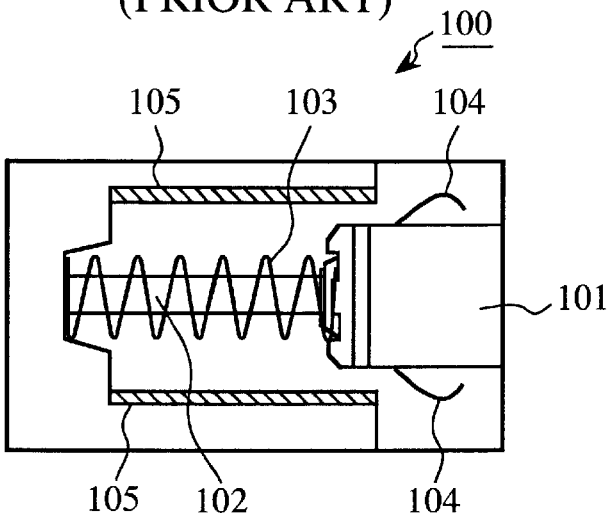
FIG.12 (PRIOR ART)
FIG. 12. is a side view to show the schematic configuration of a conventional acceleration detecting device.
Figure 13A:
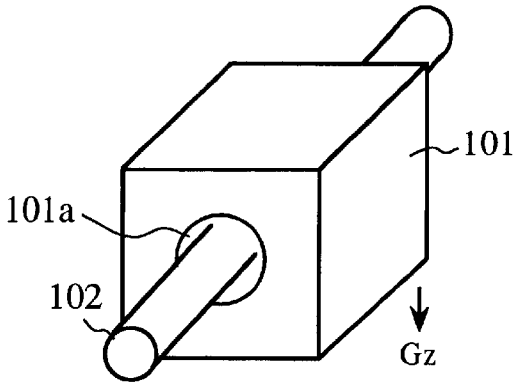
FIG.13A (PRIOR ART)
FIGS. 13A and 13B is an illustration of a mass body and a sliding shaft constituting a conventional acceleration detecting device.
Figure 13B:
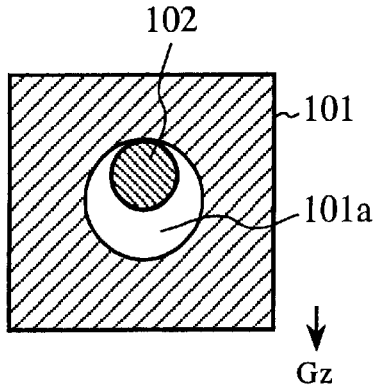
FIG.13B (PRIOR ART)
Figure 14:
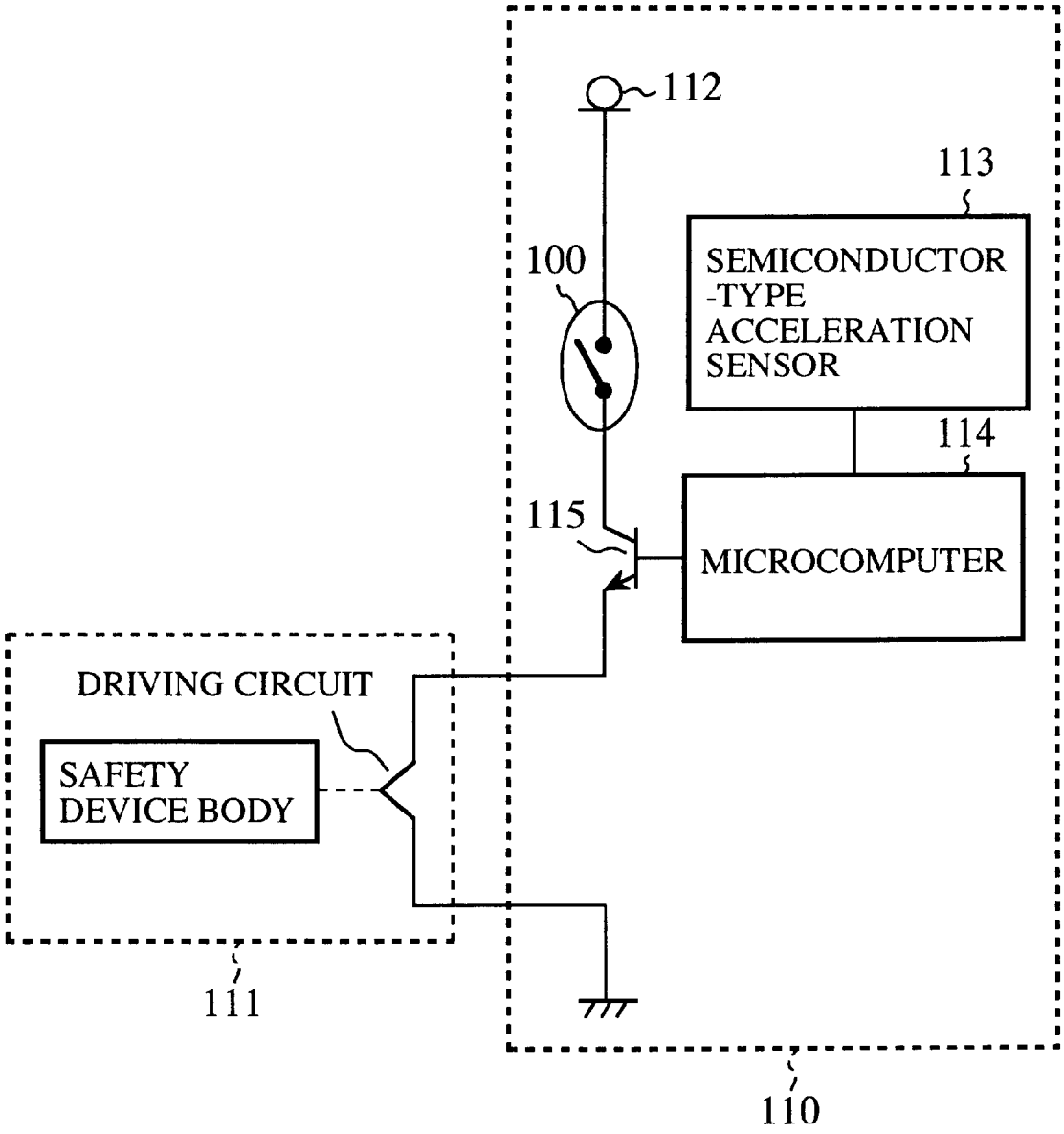
FIG. 14 (PRIOR ART)
FIG. 14 is a circuit to show the electric configuration of a control unit including a conventional acceleration detecting device and a passive safety device.
Figure 15A:
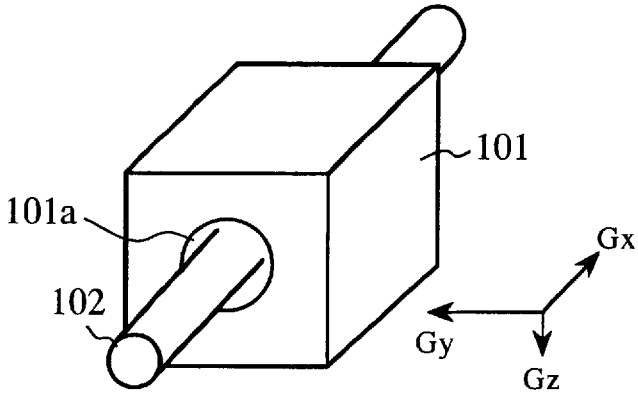
FIGS. 15A, 15B and 15C are illustrations to show the state where a mass body comes in contact with a sliding shaft when a vehicle collides obliquely with an object.
Figure 15B:
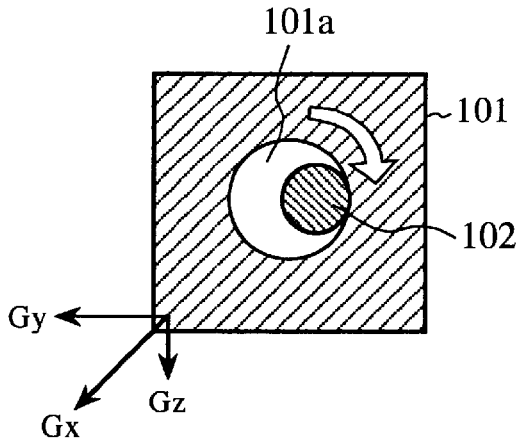
Figure 15C:
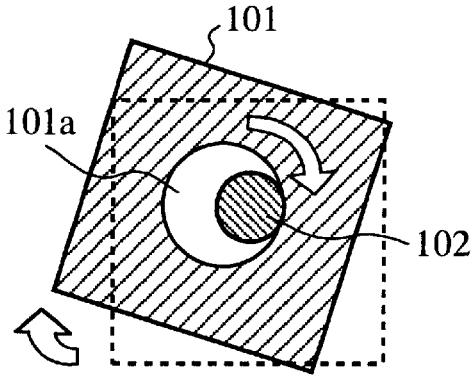

FIGS. 10A and 10B are cross-sectional views to show the state of the mass body 32 and the sliding shaft 22 when the vehicle collides obliquely with the object. In FIG. 10A, a reference character Gz denotes a gravity component applied to the mass body 1 and a reference character Gx denotes an impact acceleration component in the direction of the sliding shaft 22. A reference character Gy denotes an impact acceleration component in the left and right direction, assuming that the direction of the sliding shaft 22 is the front and rear direction. A curved thick arrow denotes a rotational moment.

In the case where the oblique collision occurs, the acceleration components Gx and Gy in the horizontal direction are larger than the gravity component Gz and thus the mass body 31 moves in the horizontal direction (in the left and right direction) at an angle of 90 degrees with respect to the sliding shaft 22 and comes in contact with the sliding shaft 22 at one point in the left and right direction.

However, the mass body 31 is triangular in cross section; that is, it is formed in such a shape that the sliding shaft 22 comes in contact with the mass body 31 at the two points 33*a* and 33*b* in the ordinary state to support the mass body 31, thereby reducing the amount of movement in the left and right direction of the mass body 31. For this reason, this can reduce the frictional force produced between the mass body 31 and the sliding shaft 22 to restrain the rotational moment and also the rotation of the mass body 1.

FIG. 10B is a cross-sectional view to show the state where the rotation of the mass body 31 is restrained. Since the rotational moment depends on the frictional force, it is possible to restrain the rotation of the mass body 31 by reducing the frictional force. Further, the base plane of the mass body 31 being about to rotate comes into contact with the sliding shaft 22 to regulate the rotation of the mass body 31.

As described above, according to the embodiment 4, when the cross section of the sliding shaft 22 is circular, the cross section of the mass body 31 is formed in the shape of a triangle, that is, in such a shape that the sliding shaft 22 comes in contact with the through hole 31*a* at the two points 33*a* and 33*b* to support the mass body 31. Therefore, the present embodiment 4 can produce the same effects as the embodiment 1.

Further, according to the present embodiment 4, the mass body 31 has the base plane 31*b* of the through hole 31*a* and thus further restrains the rotation of the mass body 31 when the oblique collision occurs. Therefore, the present embodiment 4 can produce an effect of further stably sliding the mass body 31.

In the embodiments 1 through 4, the general configuration and operation of the acceleration detecting device and the operation of the control unit circuit including this is the same as the conventional ones, so their detailed description will be omitted.

While it is assumed in the embodiments 1 through 4 that the mass body is made of brass, the mass body may be made of copper or zinc.

Further, the mass body may be made of a magnet. In this case, a lead switch which is turned on or off when a predetermined impact is applied to the vehicle is provided in the sliding shaft. If the position of the mass body is identified and the passive safety device is controlled by this configuration, it is possible to prevent the passive safety device from being operated by a small impact when the vehicle runs in the ordinary state.

In any one of the embodiments 1 through 4, the acceleration detecting device is constituted such that the sliding shaft comes in contact with the through hole at two points to support the mass body. However, the number of the contact points is not required to be two if the amount of movement of the mass body in the direction of 90 degrees with respect to the sliding shaft can reduced when the vehicle collides obliquely with the object.

Further, if it is possible that the sliding shaft comes in contact with the through hole at two or more points, the size and shape of the through hole and sliding shaft are not limited to those in the embodiments 1 though 4.

As described above, according to the present invention, the acceleration detecting device has the mass body having the predetermined mass and the through hole made through the mass body and the sliding shaft passing through the through hole and sliding the mass body, and is constituted such that the sliding shaft comes in contact with the through hole at two or more points to support the mass body. Thus, when the vehicle collides obliquely with the object, this configuration can reduce the amount of movement of the mass body in the horizontal direction at an angle of 90 degrees with respect to the sliding shaft to thereby restrain the rotational moment from being produced by the frictional force generated between the mass body and the sliding shaft. Therefore, this can produce the effect of providing the acceleration detecting device in which the mass body does not rattle but stably moves when the mass body slides.

According to the present invention, the acceleration detecting device is constituted such that when the through hole is circular in cross section, the sliding shaft is formed in such a shape that the sliding shaft comes in contact with the through hole at two or more contact points to support the mass body. Thus, when the vehicle collides obliquely with the object, this configuration can reduce the amount of movement of the mass body in the horizontal direction at an angle of 90 degrees with respect to the sliding shaft to restrain the rotational moment from being produced by the frictional force generated between the mass body and the sliding shaft. Therefore, this can produce the effect of providing the acceleration detecting device in which the mass body does not rattle but stably moves when the mass body slides. In addition, this can produce the effect of providing the acceleration detecting device moving stably without forming the through hole in a complex shape.

According to the present invention, the acceleration detecting device is constituted such that the sliding shaft has the cross section formed in the shape of the oblong circle elongated in the lateral direction. Therefore, this can produce the effect of forming the sliding shaft by an easy method such as the die molding method or the like.

According to the present invention, since the acceleration detecting device is constituted such that the sliding shaft has the projection to regulate the rotation of the mass body, the projection can further restrain the mass body from being rotated when the oblique collision occurs. Therefore, this can produce the effect of providing the acceleration detecting device capable of further stably sliding the mass body.

According to the present invention, the acceleration detecting device is constituted such that when the sliding shaft is circular in cross section, the through hole is formed in such a shape that the sliding shaft comes in contact with the through hole at two or more points to support the mass body. Thus, when the vehicle collides obliquely with the object, this configuration can reduce the amount of movement of the mass body in the horizontal direction at an angle of 90 degrees with respect to the sliding shaft to restrain the rotational moment from being generated by the frictional force produced between the mass body and the sliding shaft. Therefore, this can produce the effect of providing the acceleration detecting device in which the mass body does not rattle but can stably move when the mass body slides. In addition, this can produce the effect of providing the acceleration detecting device moving stably without forming the sliding shaft in a complex shape.

According to the present invention, since the acceleration detecting device is constituted such that the through hole has a plane to regulate the rotation of the mass body, the through hole can restrain the mass body from being rotated when the vehicle collides obliquely with the object. Therefore, this can produce the effect of providing the acceleration detecting device in which the mass body can further stably slide.

What is claimed is:

1. An acceleration detecting device comprising:

a mass body having a predetermined mass and a through hole made through the mass body; and a sliding shaft passing through the through hole and sliding the mass body, wherein the sliding shaft comes in contact with the through hole at only two points to support the mass body.

2. An acceleration detecting device according to claim 1, wherein when the through hole is circular in cross section, the sliding shaft is formed in such a shape that the sliding shaft comes in contact with the through hole at two points to support the mass body.

3. An acceleration detecting device comprising:

a mass body having a predetermined mass and a through hole made through the mass body; and a sliding shaft passing through the through hole and sliding the mass body, wherein the sliding shaft comes in contact with the through hole at two or more points to support the mass body, wherein when the through vole is circular in cross section, the sliding shaft is formed in such a shape that the sliding shaft tomes in contact with the through hole at two or more points to support the mass body, wherein the sliding shaft has a cross section formed in the shape of an oblong circle elongated in the lateral direction.

4. An acceleration detecting device comprising:

a mass body having a predetermined mass and a through hole made through the mass body; and a sliding shaft passing through the through hole and sliding the mass body, wherein the sliding shaft comes in contact with the through hole at two or more points to support the mass body, wherein when the through hole is circular in cross section, the sliding shaft is formed in such a shape that the sliding shaft homes in contact with the through hole at two or more points to support the mass body, wherein the sliding shaft has a projection for regulating the rotation of the mass body.

5. An acceleration detecting device according to claim 1, wherein when the sliding shaft is circular in cross section, the through hole is formed in such a shape that the sliding shaft comes in contact with the through hole at two points to support the mass body.

6. acceleration detecting device comprising:

a mass body having a predetermined mass and a through hole made through the mass body; and a sliding shaft passing through the through hole and sliding the mass body, wherein the sliding shaft comes in contact with the through hole at two or more points to support the mass body wherein when the sliding shift is circular in cross section, the through hole is formed in such a shape that the sliding shaft comes in contact with the through hole at two or more points to support the mass body, wherein the through hole has a plane for regulating the rotation of the mass body.

7. An acceleration detecting device comprising:

a mass body having a predetermined mass and a through hole made through the mass body; and a sliding shaft passing through the through hole and sliding the mass body, wherein the sliding shaft comprises in contact with the through hole at two or more points, wherein at least one of said through hole and said sliding shaft has a non-circular cross section.

8. The acceleration detecting device according to claim 7, wherein said sliding shaft comes into contact with said through hole at no more than three points.

9. The acceleration detecting device according to claim 7, wherein said at least one of said through hole and said sliding shaft has a triangular cross section.

10. The acceleration detecting device according to claim 7, wherein said at least one of said through hole and said sliding shaft has an elliptical cross section.

* * * * *